US005438339A

United States Patent [19]

Itoh et al.

[11] Patent Number: 5,438,339

[45] Date of Patent: Aug. 1, 1995

[54] ANTENNA FOR A RADIO COMMUNICATION APPARATUS

[75] Inventors: Ryoh Itoh; Yukio Yokoyama; Takao Ono, all of Tokyo, Japan

[73] Assignee: NEC Corporation, Tokyo, Japan

[21] Appl. No.: 201,338

[22] Filed: Feb. 24, 1994

[30] Foreign Application Priority Data

Feb. 26, 1993 [JP] Japan ..... 5-037689

[51] Int. Cl.[6] ..... H01Q 1/24

[52] U.S. Cl. ..... 343/702; 343/895

[58] Field of Search ..... 343/702, 895, 900, 901, 343/729, 725, 749, 752; H01Q 1/24, 1/36; 455/89, 90

[56] References Cited

U.S. PATENT DOCUMENTS

| | | | |
|---|---|---|---|
| 4,121,218 | 10/1978 | Irwin et al. | 343/702 |
| 4,868,576 | 9/1989 | Johnson, Jr. | 343/702 |
| 5,168,278 | 12/1992 | Morita | 343/702 |
| 5,177,492 | 1/1993 | Tomura et al. | 343/702 |
| 5,204,687 | 4/1993 | Elliott et al. | 343/895 |
| 5,317,325 | 5/1994 | Bottomley | 343/895 |

FOREIGN PATENT DOCUMENTS

| | | | |
|---|---|---|---|
| 0372720 | 6/1990 | European Pat. Off. . | |
| 0516490A2 | 12/1992 | European Pat. Off. | H01Q 1/24 |
| 4-318701 | 11/1992 | Japan | H01Q 1/24 |
| WO92/16980 | 10/1992 | WIPO . | |
| 94/10720 | 5/1994 | WIPO | H01Q 1/24 |

OTHER PUBLICATIONS

By J. Wiggenhorn, "Hel/Tel Antenna", Motorola Technical Developments, Jun. 1993, vol. 19, p. 118.

*Primary Examiner*—Donald Hajec
*Assistant Examiner*—Hoanganh Le
*Attorney, Agent, or Firm*—Young & Thompson

[57] ABSTRACT

A miniature and high performance antenna applicable to a radio communication apparatus and made up of a straight antenna rod and an antenna coil or coil element. A first whip antenna has a first portion retractable into the casing of the apparatus and a second portion constantly positioned externally of the casing. A second whip antenna has a coil element in the form of a loading coil having a predetermined number of turns. The second whip antenna is coaxially provided on the upper end of the first whip antenna and slidable relative to and in the axial direction of the first whip antenna. The second portion of the first whip antenna is movable between a position where one end of the coil element is disengaged from one end of the second portion and a position where the former is engaged with the latter. The antenna exhibits a desirable electric characteristic when pulled out of the casing of the apparatus and, in addition, promotes the efficient use of the limited space available in the casing.

10 Claims, 5 Drawing Sheets

ANTENNA FOR A RADIO COMMUNICATION APPARATUS

BACKGROUND OF THE INVENTION

The present invention relates to a miniature and high performance antenna applicable to a radio communication apparatus and made up of a straight antenna rod and an antenna coil or coil element.

Portable radio communication apparatuses, including hand-held telephones, are extensively used today. To enhance portability, the casing of this kind of apparatus is decreasing in size and weight. An antenna small enough to be retracted even into such a small casing has been proposed in various forms. The prerequisite with the apparatus, or bidirectional communicating means, is that it can respond to a call originated on a remote station even when the small antenna is retracted into the casing. Further, there is an increasing demand for higher antenna sensitivity. In the light of this, it has been customary to provide the apparatus with a built-in antenna in addition to the retractable antenna and use them selectively. However, the problem with this approach is that the apparatus has a complicated and bulky construction. To eliminate this problem, there has been proposed an antenna made up of a straight antenna rod and a short antenna having a loading coil. In this type of antenna, the antenna rod and short antenna are joined coaxially with each other such that only the short antenna works when the antenna rod is held in a retracted position.

However, the conventional antenna of the type described cannot achieve a desirable electric characteristic when the antenna rod is pulled out of the casing of the apparatus. Moreover, such an antenna cannot be miniature enough to promote the effective use of a space available in the casing.

SUMMARY OF THE INVENTION

It is, therefore, an object of the present invention to provide an antenna for a radio communication apparatus which exhibits an improved electric characteristic when a straight antenna rod is extended from the casing of the apparatus.

It is another object of the present invention to provide an antenna for a radio communication apparatus which promotes the effective use of a limited space available in the apparatus by reducing the total length when a straight antenna rod is retracted into the casing.

An antenna for a radio communication apparatus of the present invention comprises a first whip antenna having a first portion retractable into the casing of the apparatus and a second portion constantly positioned externally of the casing, and a second whip antenna having a coil element in the form of a loading coil having a predetermined number of turns. The second whip antenna is coaxially provided on the upper end of the first whip antenna and slidable relative to and in the axial direction of the first whip antenna. The second portion of the first whip antenna is movable between a position where one end of the coil element is disengaged from one end of the second portion and a position where the former is engaged with the latter.

BRIEF DESCRIPTION OF THE DRAWINGS

The above and other objects, features and advantages of the present invention it will become more apparent from the following detailed description taken with the accompanying drawings in which.

DESCRIPTION OF THE PREFERRED EMBODIMENT

Figure 6:
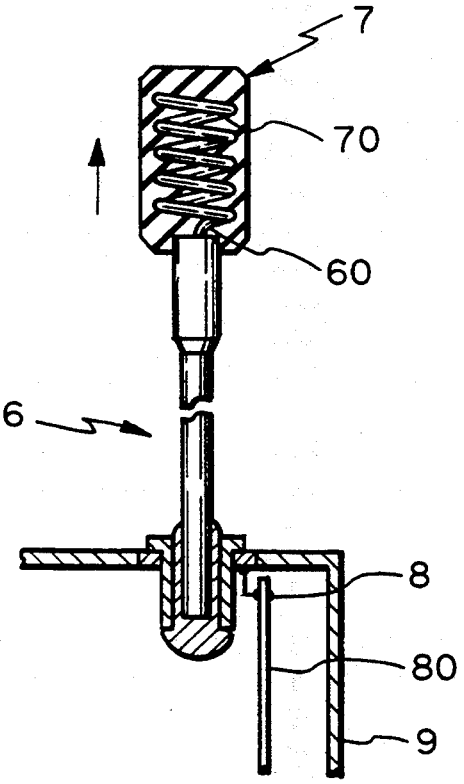
Fig. 6 PRIOR ART
FIG. 6 is a section showing a conventional antenna in an extended position.
Figure 7:
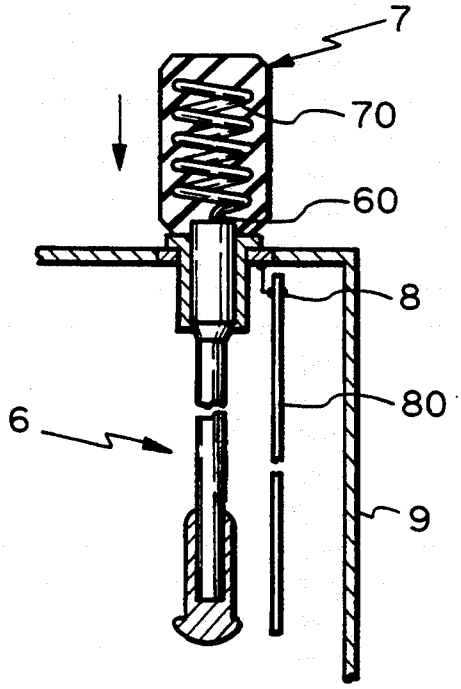
Fig. 7 PRIOR ART
FIG. 7 is a view similar to FIG. 6, showing the antenna in a retracted position.

To better understand the present invention, a brief reference will be made to a conventional small size antenna, shown in FIGS. 6 and 7. As shown, the antenna (referred to as a first antenna hereinafter) is mounted on the casing 9 of a radio communication apparatus and made up of a straight antenna rod 6 and a short antenna section 7 provided on the tip of the rod 6. The antenna rod 6 has an electrical length which is substantially one-quarter of the resonance wavelength. The short antenna section 7 has an electrical length of substantially one-quarter of the resonance wavelength. A loading coil, or antenna coil, 70 is disposed in the antenna section 7 and has a predetermined number of turns. As shown in FIG. 6, when the antenna rod 6 is extended from the casing 9, the antenna rod 6 and loading coil 70 constitute a substantially half wavelength antenna in combination. As shown in FIG. 7, when the antenna rod 6 is retracted into the casing 9, only the short antenna section 7 with the coil 70 is positioned externally of the casing 9 and serves as a quarter wavelength antenna. There are also shown in the figures a circuit board 80, and a feed portion 8.

Figure 8:
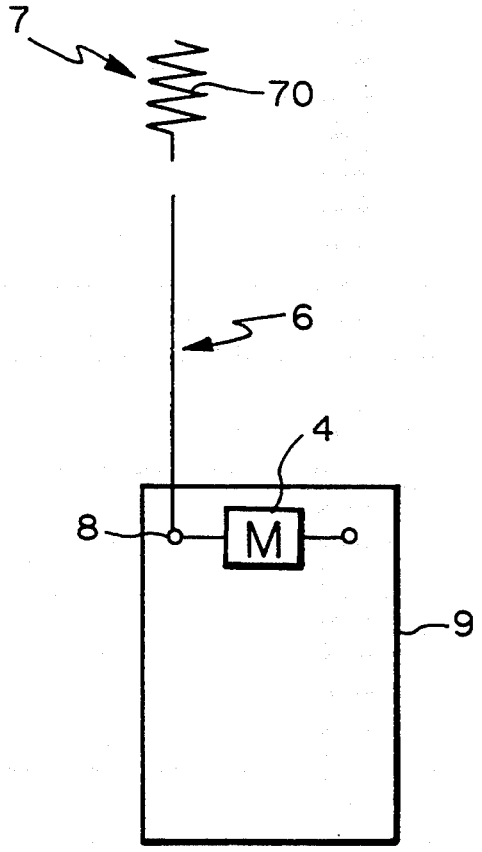
Fig. 8 PRIOR ART
FIG. 8 is a schematic of another conventional antenna in an extended position.
Figure 9:
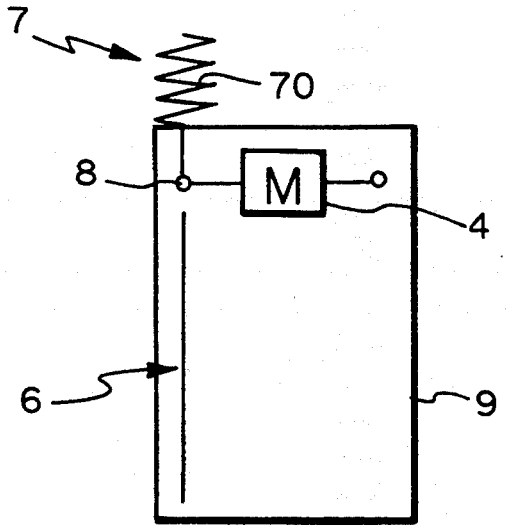
Fig. 9 PRIOR ART
FIG. 9 is a view similar to FIG. 8, showing the antenna in a retracted position.

FIGS. 8 and 9 show another conventional small size antenna (referred to as a second antenna hereinafter). The same or similar constituent parts of this antenna as or to the constituents of the antenna described above are designated by the same reference numerals, and a detailed description thereof will not be made in order to avoid redundancy. As shown, the antenna rod 6 and the antenna coil, or coiled element, 70 each having a quarter wavelength are physically separate from each other. As shown in FIG. 8, when the antenna rod 6 is extended from the casing 9, the antenna is fed at the lower end of the antenna rod 6 with the result that substantially only the antenna rod 6 plays the role of an antenna. As shown in FIG. 9, when the antenna rod 6 is retracted into the casing 9, it is disconnected from the feed portion 8 while, at the same time, the lower end of the coil 70 is brought into connection with the feed portion 8. In this condition, only the coil 70 serves as a short antenna. In the figures, the reference numeral 4 designates a matching circuit.

Regarding the structure, the first and second antennas described above are simpler than traditional small size antennas. However, the electric characteristic available with the first antenna is not desirable when the quarter wavelength antenna rod 6 is extended from the casing 9. Another problem with the first antenna is that gain is low since the coil 70 degrades the electric performance of the antenna rod 6. It is extremely difficult to eliminate this problem. In the second antenna, the coil 70 is spaced apart a predetermined distance from the tip of the antenna rod 6. The second antenna, therefore, needs an extra space for accommodation in the casing 9. Moreover, both of the first and second antennas have a drawback that the total length of the antenna rod 6 and coil 70 is constant and cannot be reduced, as needed.

Figure 5:
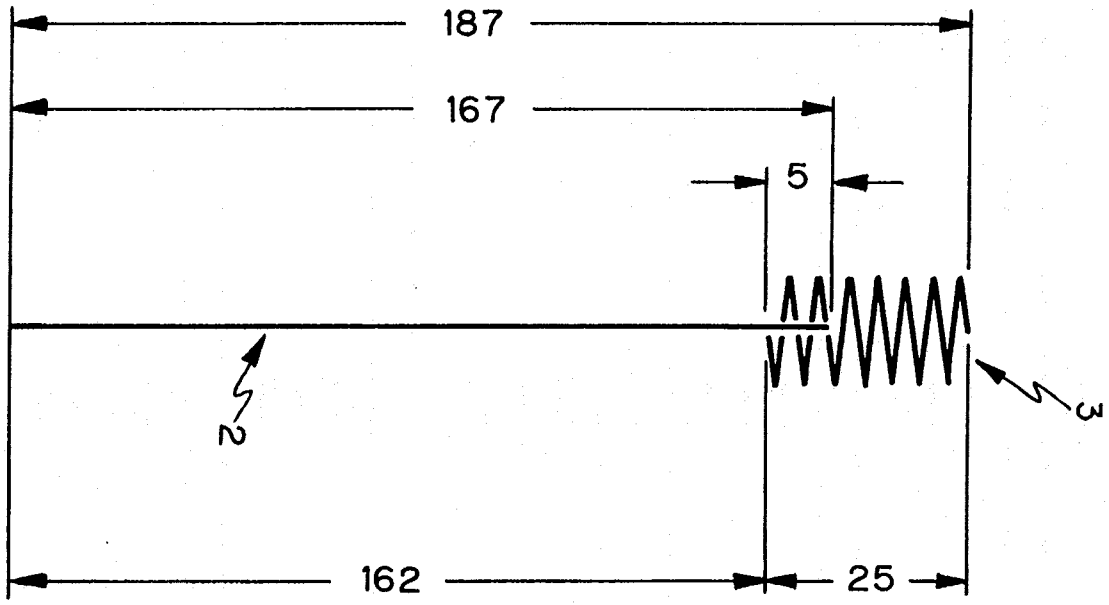
FIG. 5 is a schematic showing specific dimensions of various portions included in the embodiment, as measured in the retracted position.

Referring to FIGS. 1–5, an antenna embodying the present invention will be described. The illustrative embodiment pertains to a portable hand-held telephone using a 900 MHz frequency band. As shown, the antenna has a half wavelength whip antenna 2 (e.g. 167 mm as shown in FIG. 5) and a quarter wavelength short whip antenna 3 (e.g. 25 mm as shown in FIG. 5) provided on the tip of the whip antenna 2. The whip antenna 3 is coaxial with and slidable relative to the whip antenna 2. A loading coil or coil element 31 is accommodated in the whip antenna 3 and has a predetermined number of turns. The whip antenna 3 is enclosed within a case 30 made of resin. A bore 33 is formed in the case 30 internally of the coil 31. An upper and a lower annular projection 32 are formed on the wall of the case 30 defining the bore 33. A hole is formed through the bottom of the case 30 for receiving the upper end of the whip antenna 2.

Figure 1:
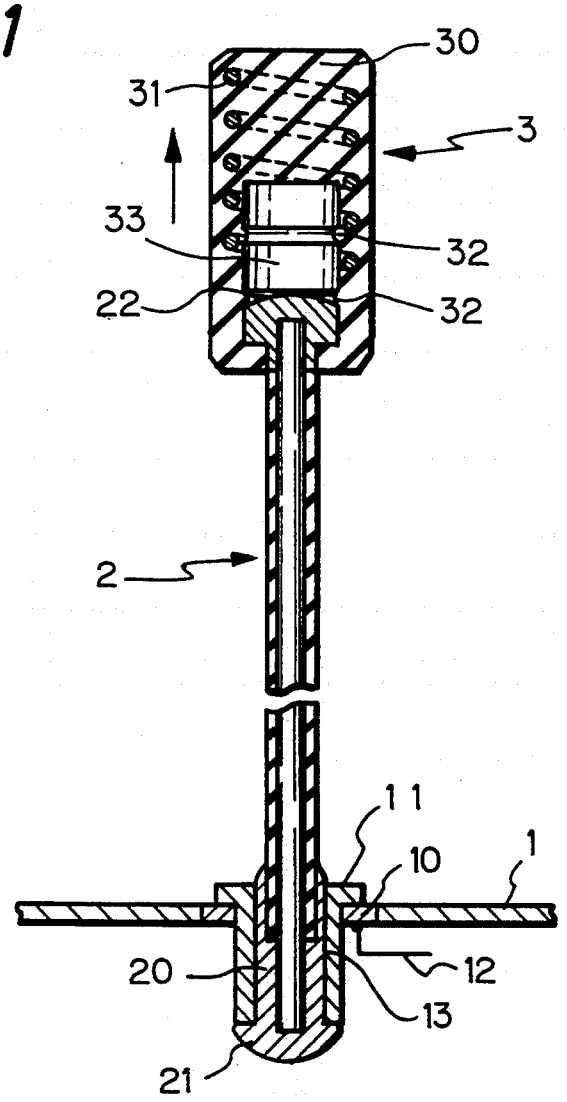
FIG. 1 is a partly sectioned elevation showing an antenna embodying the present invention in an extended position.

The whip antenna 2 is a flexible rod made of synthetic resin and having a flexible antenna core thereinside. A movable connector 20 is fitted on the lower end of the whip antenna 2 and held in conduction with the antenna core. The movable connector 20 is made of brass. Stops 21 and 22 are respectively provided on the lower end and upper end of the whip antenna 2. The upper stop 22 is received in the bore 33 via the hole of the case 30. The lower stop 21 is received in the casing 1 of the telephone and slidable deeper into the casing 1 away from the top wall of the casing 1 which is formed with an opening. A cylindrical O-ring 10 is fitted in the opening of the top wall of the casing 1. A feed portion 12 extending from a circuit board, not shown, is connected to the O-ring 10. A hollow cylindrical fixed connector 11 is fitted in the O-ring 10. As shown in FIG. 1, when the whip antenna 2 is extended from the casing 1, the lower stop 21 abuts against the fixed connector 11. In this condition, the movable connector 20 is electrically connected to the feed portion 12 via the fixed connector 11 and O-ring 10. In FIG. 1, the reference numeral 13 designates a feed point.

Figure 2:
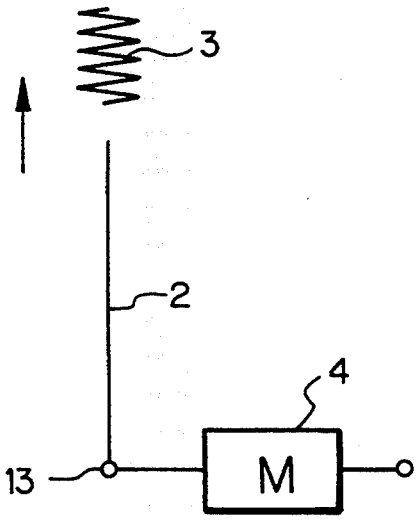
FIG. 2 is a schematic associated with FIG. 1.

Specifically, assume that the user of the telephone has held the case 3 and pulled the whip antenna 3 out of the casing 1. Then, the upper stop 22 is brought to below the lower annular projection 32. Hence, the lower end of the coil 31 is spaced apart from the tip of the whip antenna 2 and, therefore, separated from the latter physically and electrically. At the same time, the whip antenna 2 is fed from the feed point 13 at the lower end thereof. In this condition, substantially only the whip antenna 2 works as an antenna having a desirable electric characteristic without being effected by the coil 31. More specifically, as shown in FIG. 2, the short whip antenna 3 is, in effect, practically absent; only the whip antenna 2 is connected to a matching circuit 4 via the feed point 13. Although the total length of the whip antennas 2 and 3 is maximum, it is not critical at all since the whip antenna 2 is in the extended position.

Figure 3:
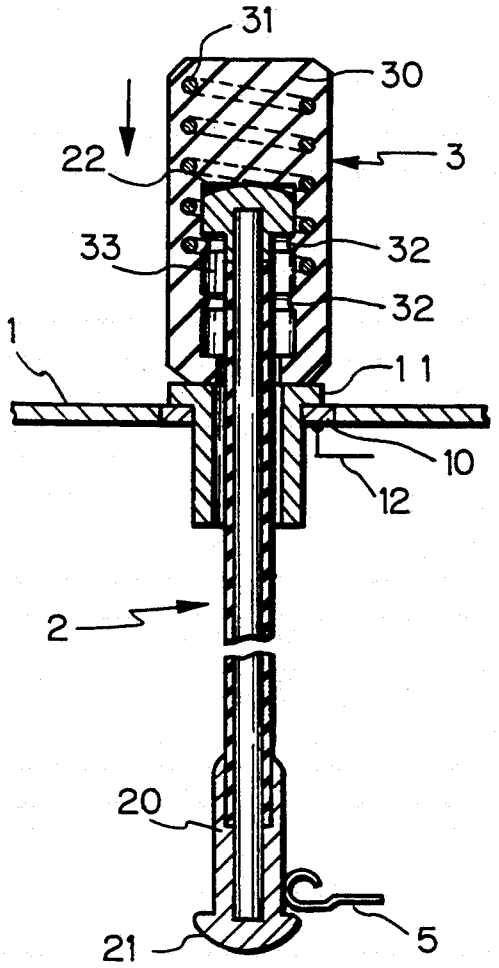
FIG. 3 is a view similar to FIG. 1, showing the antenna in a retracted position.
Figure 4:
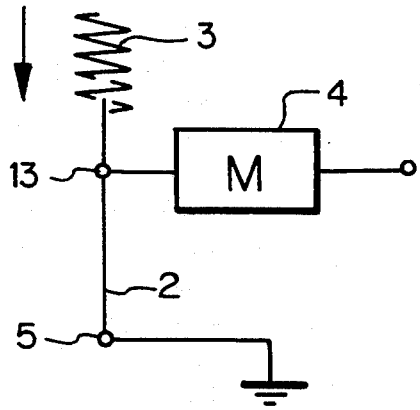
FIG. 4 is a schematic associated with FIG. 3.

As shown in FIG. 3, when the user presses the case 30 of the whip antenna 3 downward, the whip antenna 2 begins to retract into the casing 1. At this instant, the upper stop 22 moves to the upper end of the bore 33 over the lower and upper annular projections 32. This causes the lower end of the coil 31 to overlap with the upper end of the whip antenna 2 and, therefore, couples the coil 31 and antenna 2 mechanically and electrically. The whip antenna 2 is fully received in the casing 1 while having the upper end thereof positioned internally of the fixed connector 11. Consequently, the coil 31 is fed by capacity coupling. In this condition, the telephone awaits an incoming call with substantially only the coil 31 working as an antenna. As FIG. 5 shows in a schematic, the whip antenna 2 is, in effect, practically absent; only the short whip antenna 3 is coupled to the feed point 13 by capacity coupling. In this case, the total length of the whip antennas 2 and 3 is minimum and smaller than the sum of the lengths of the individual antennas 2 and 3, thereby promoting the efficient use of the limited space of the casing 1. This will be clearly understood with reference to specific dimensions shown in FIG. 5.

In the illustrative embodiment, when the whip antenna 2 is in the retracted position, the movable connector 20 carried thereon is held in contact with a metallic ground member 5 which is located in a predetermined lower portion in the casing 1. Connecting the movable connector 20 to ground is successful in making the impedance Z of the whip antenna 2 infinite and, therefore, in fully shutting off the feed to the antenna 2.

Regarding the upper stop 22 received in the whip antenna 3 and annular projections 32, when the whip antenna 2 is extended or retracted, they will allow the user to see if the whip antenna 3 is settled at the expected position or not by a tactual sense.

If desired, the whip antenna or antenna rod 2 may be provided with a telescopic configuration. Both the whip antenna 2 and the coil 31 may be of any desired wavelength capable of implementing transmission and reception, e.g., quarter or half wavelength. Further, the slidable configuration of the whip antenna. 2 and coil 31 may be implemented by a bellows or a conventional arrangement for a rod antenna.

In summary, in accordance with the present invention, an antenna has an antenna coil having a predetermined number of turns and and provided on the upper end of a straight antenna rod. The coil is coaxial with and slidable relative to the antenna rod. When the coil is pulled upward, the lower end of the coil is moved away from the upper end of the antenna rod and, therefore, separated from the latter mechanically and electrically. Specifically, when the antenna rod is extended, the coil is moved away from the tip of the rod while the rod is fed at the lower end thereof. As a result, substantially only the antenna rod works as an antenna having a desirable electric characteristic without being effected by the coil. This is also true when the antenna rod is implemented as a telescopic rod antenna. On the other hand, when the antenna rod is pushed downward, the tip of the rod moves into the coil via the lower end of the coil. Consequently, the antenna rod and coil are coupled mechanically and electrically. Specifically, the total length of the antenna rod and coil is further reduced. In this condition, the coil overlaps with the tip of the antenna rod and is fed by capacity coupling via a feed point adjoining the tip of the rod. In this condition, substantially only the coil works as an antenna. The antenna, therefore, exhibits a desirable electric characteristic when pulled out of the casing of a radio communication apparatus and, in addition, promotes the efficient use of the limited space available in the casing.

Various modifications will become possible for those skilled in the art after receiving the teachings of the present disclosure without departing from the scope thereof.

What is claimed is:

1. An antenna for a radio communication apparatus, comprising:

a first whip antenna having a first portion retractable into a casing of said apparatus and a second portion constantly positioned externally of said casing; and a second whip antenna having a coil element in the form of a loading coil having a predetermined number of turns, said second whip antenna being coaxially provided on an upper end of said first whip antenna and slidable relative to and in an axial direction of said first whip antenna such that said second portion of said first whip antenna is movable between a position where one end of said coil element is disengaged from one end of said second portion and a position where said one end of said coil element is engaged with said one end of said second portion.

2. An antenna as claimed in claim 1, wherein said coil element of said second whip antenna is disposed in a case made of synthetic resin, said case having a bore coaxial with said loading coil.

3. An antenna as claimed in claim 2, wherein said second portion of said first whip antenna has a greater diameter than said first portion and is slidably received in said bore of said case.

4. An antenna as claimed in claim 2, wherein said case comprises annular positioning ribs projecting radially inwardly of said bore, said annular positioning ribs releasably retaining said one end of said coil element in one or the other of said engaged and disengaged positions.

5. An antenna as claimed in claim 2, further comprising a connector portion mounted on said casing and surrounding said first whip antenna, said connector portion connecting (a) said first whip antenna to a feed means when said first portion of said first whip antenna is extended from said casing and said one end of said second portion is disengaged from said coil element, and (b) said second whip antenna to said feed means when said first portion of said first whip antenna is retracted into said casing and said one end of said second portion is engaged with said coil element.

6. An antenna as claimed in claim 5, wherein said first and second portions of said first whip antenna and said bore of said case are so dimensioned that when said first portion is retracted into said casing and said one end of said second portion is in said engaged position, said case contacts said connector portion.

7. An antenna as claimed in claim 6, further comprising a ground member mounted inside said casing and making electrical contact with said first whip antenna when said first portion of said first whip antenna is retracted into said casing.

8. An antenna as claimed in claim 1, wherein said first whip antenna has a telescopic rod antenna structure.

9. An antenna as claimed in claim 1, further comprising a connector portion mounted on said casing and surrounding said first whip antenna, said connector portion connecting (a) said first whip antenna to a feed means when said first portion of said first whip antenna is extended from said casing and said one end of said second portion is disengaged from said coil element, and (b) said second whip antenna to said feed means when said first portion of said first whip antenna is retracted into said casing and said one end of said second portion is engaged with said coil element.

10. An antenna as claimed in claim 1, further comprising a ground member mounted inside said casing and making electrical contact with said first whip antenna when said first portion of said first whip antenna is retracted into said casing.

* * * * *